US005161460A

United States Patent [19]

Andersen et al.

[11] Patent Number: 5,161,460

[45] Date of Patent: Nov. 10, 1992

[54] SCREEN PRINTING APPARATUS FOR MULTIPLE SIMULTANEOUS PRINTING WITH ACCURATE REGISTRATION

[76] Inventors: Edward A. Andersen; Eric T. Andersen, both of P.O. Box 3787, Charlottesville, Va. 22903

[21] Appl. No.: 803,613

[22] Filed: Dec. 9, 1991

[51] Int. Cl.[5] ..... B41L 13/04

[52] U.S. Cl. ..... 101/116; 101/115; 101/127.1

[58] Field of Search ..... 101/114, 115, 116, 117, 101/118, 119, 120, 121, 122, 123, 126, 127, 127.1, 128, 128.1, 128.21, 128.4, 129

[56] References Cited

U.S. PATENT DOCUMENTS

| | | | |
|---|---|---|---|
| 4,735,139 | 4/1988 | Szarka | 101/126 |
| 4,738,909 | 4/1988 | Jennings | 101/126 |
| 4,792,773 | 11/1990 | Barlow | 101/127.1 |
| 4,907,506 | 3/1990 | Davis | 101/129 |
| 4,909,146 | 3/1990 | Szarka | 101/126 |
| 4,938,130 | 7/1990 | Thorpe | 101/126 |
| 4,949,635 | 8/1990 | Padula | 101/128.1 |

FOREIGN PATENT DOCUMENTS

| | | | |
|---|---|---|---|
| 1256 | 1/1984 | Japan | 101/129 |

*Primary Examiner*—Glifford D. Crowder
*Assistant Examiner*—Joseph R. Keating

[57] ABSTRACT

A multiple screen printing apparatus is disclosed which can be manufactured to loose manufacturing tolerances but yet can print "all screens-down" with accurate and repeatable registration. The registration is a result of having two complementary components for both distance and angular registration which are located near the printing end of the apparatus. The apparatus includes a spring biased loose carrying connection that causes the registration components to seat accurately with one another as the screen is brought into engagement with the workpiece.

20 Claims, 5 Drawing Sheets

SCREEN PRINTING APPARATUS FOR MULTIPLE SIMULTANEOUS PRINTING WITH ACCURATE REGISTRATION

This invention relates to a screen printing apparatus where a plurality of screens may be simultaneously placed on a plurality of workpieces for screen printing.

BACKGROUND OF THE INVENTION

Screen printing is a big business that continues to grow with the technology being used on tee shirts, caps, sleeves, bumper stickers and other items. One type of screen printing apparatus is where a multiplicity of screens are rotated about a common point to be placed over a plurality of work holders. The screens are rotated while in an elevated or raised position and then when they are over a workpiece to be printed are lowered onto the work. A number of colors are frequently printed on the same workpiece and each color must be registered with the others to give a satisfactory product. When only one screen is lowered at a time, registration with the workpiece is relatively easy. But if a multiplicity of screens are to be lowered at the same time, referred to as simultaneous printing or "all screens down" printing, registration at one work station may cause misregistration at a second work station because of imperfections in the equal spacing between the screens. Even if such spacing is set correctly at the factory, the machines will lose their initial settings in actual use. These problems were recognized in U.S. Pat. No. 4,974,508 issued Dec. 4, 1990 to the same inventors as the present invention. U.S. Pat. No. 4,974,508 is referred to and incorporated herein by reference.

The apparatus shown in U.S. Pat. No. 4,974,508 greatly improved the previous screen printing apparatus and permitted all screen heads to be lowered and acceptably registered for simultaneous printing and greatly increased the productivity of the machine. Although all the heads could be used to print simultaneously, frequently only several heads are so used at one time but even then there is significant improvement over the normal apparatus.

Even though the apparatus shown in U.S. Pat. No. in 4,974,508, as it relates to the "all screens down" feature, was a substantial improvement over prior apparatus, it was still found that the disc required a division into precise angular locations. For example, in a six color machine the disc is normally 40 inches in diameter so the angles are divided on a 20 inch radius. In such a machine the print may be at a 60 inch radius so the registration point at 20 inches to cause the prints to register at 60 inches has a multiplier of three so even if the original registration at 20 inch was set up with a 0.002 inch tolerance the registration at 60 inches would be 0.006 inches and that sometimes is not completely satisfactory.

SUMMARY OF THE INVENTION

The present invention is an improvement over the apparatus shown in U.S. Pat. No. 4,974,508, to the extent that patent pertains to the "all heads down" position. The present invention provides an apparatus that can be manufactured to loose tolerances of the angular or radial mounting of the heads in the factory but at the same time provide very precise registration between the screen and the workpiece during the printing operations. This is accomplished by providing a moveable connection between the screen arm and screen arm carrier so that the screen mounted on the screen arm can move in both a radial and angular relationship with the screen arm carrier. The screen arm carrier is connected to a vertical shaft for rotation in a horizontal plane. This connection can be made with very loose manufacturing tolerances and not affect the registration of the screen with the workpiece.

Likewise, the moveable connection between the screen arm carrier and the screen arm can also be made with very loose tolerances without affecting the registration between the screen and the workpiece.

The moveable connection between the screen arm and the screen arm carrier is spring biased to a minimum radius when the screen is in the up position. As the screen is lowered, a round bar on the screen arm is pocketed into a V assembly located on the platen support arm to fix exactly the location of the screen arm in a radial and transverse position relative to the workpiece platen at the location of the round bar. Also the round bar and V assembly are free to rotate with respect to one another so that a T register in the form of a plate located further outboard on the screen arm from the round bar determines the exact angle of rotation between the round bar and V assembly when the T register is lowered into and between two roller bearings on a registration assembly mounted on a support beam. This results in the screen and workpiece coming into an exact and repeatable registration. When the screen was originally lowered and the round bar was forced into the V assembly, the screen arm carrying the round bar was forced against the spring bias mentioned earlier to increase the radial dimension of the screen arm's location from a vertical center axis of rotation of the screen printing apparatus.

Through this specification a single station will be primarily described, but it is to be understood that the apparatus is a multiple station machine and the quantity of stations can vary from two to up to as many as ten or even higher. Usually only two to three operators print on an apparatus at the same time. Although, in principle, one operator could be assigned to each printing station.

BRIEF DESCRIPTION OF THE DRAWINGS

Further understanding of the advantages of the present invention, together with additional features contributing thereto, will be apparent from the following description of a preferred embodiment when read in conjunction with the accompanying drawings wherein.

DESCRIPTION OF THE PREFERRED EMBODIMENT

Figure 1:
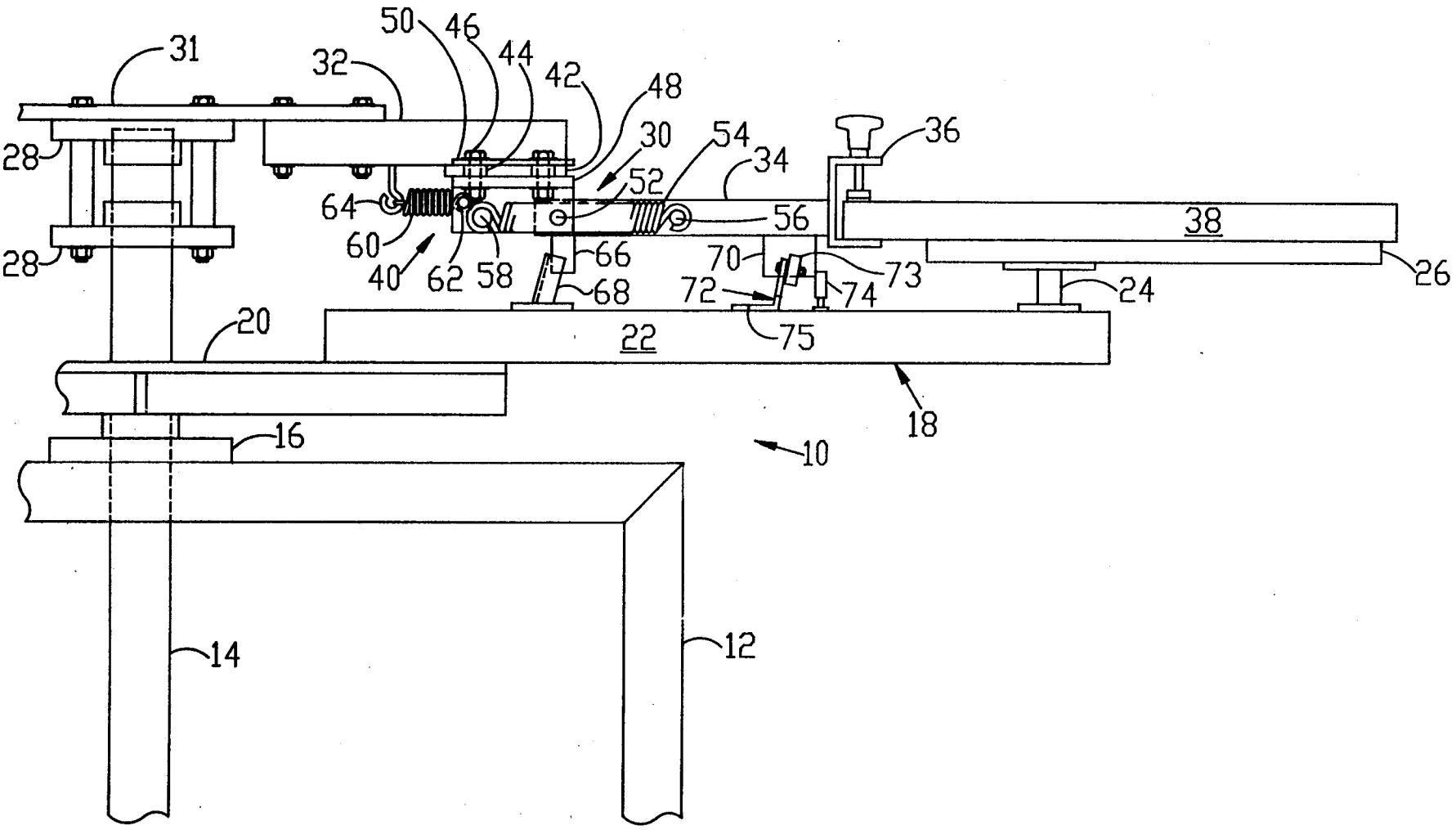
FIG. 1 is a schematic view of one work station mounted on a schematic, broken away view of part of the screen printing apparatus base.
Figure 2:
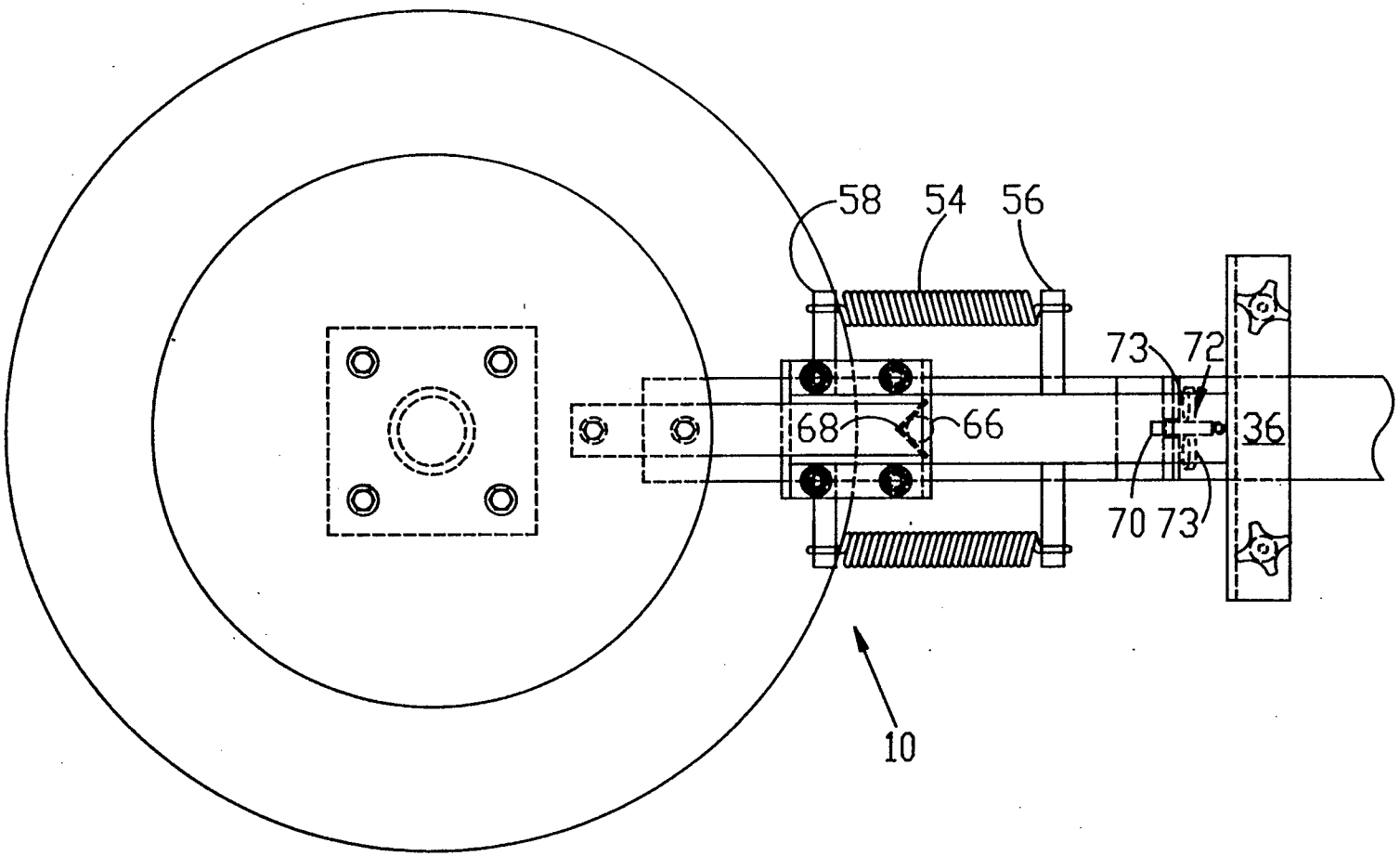
FIG. 2 is a schematic plan view of part of the apparatus shown in FIG. 1.

With reference to FIGS. 1 and 2 there is shown the screen printing apparatus 10 of the present invention. The apparatus shown includes a mounting base 12 upon which is mounted a vertical shaft 14 which is free to rotate in upper bearing 16 and a lower bearing which is not shown in the Figures. Fixed to the vertical shaft 14 is a platen or workpiece carrying assembly 18 which includes a platen or workpiece carrier head or workpiece carrying assembly mount 20.

The platen or workpiece carrier head 20 is fixed to the vertical shaft 14 and rotates therewith as the vertical shaft rotates in upper bearing 16 and a lower bearing (not shown).

While only one station is shown for illustration purposes in FIGS. 1 and 2, it is clearly understood by those skilled in the art that multiple stations will be provided and as stated earlier there will be at least two, normally four to six, and as many ten or twelve or more. For a view of the lower bearing and the use of multiple stations reference is made to the present inventors' earlier U.S. Pat. No. 4,974,508.

The platen or workpiece carrying assembly 18 in addition to the platen or workpiece carrier head or mount 20 also has a platen or workpiece support beam or arm 22 extending radially outward from and carried by the workpiece carrier head. Near the outboard end of the workpiece support beam 22 is provided a workpiece or platen carrier mount 24 which attaches the workpiece carrier or platen 26 to the support arm. The tee shirt or other workpiece upon which the printing is made is placed on the platen or workpiece carrier 26 to be held thereby during the printing operation.

Carried near the top of the vertical shaft 14 are two bearing assemblies 28 which freely rotate about the vertical shaft. bearing assemblies 28 have thereon mounted thereon a screen carrying assembly 30 which includes a screen carrier head 31 that is attached to the bearings 28 and further includes a radially extending screen arm mounted on said screen carrier head or screen carrying assembly mount 31. The radially extending screen arm includes an inboard screen arm 32 and an outboard screen arm 34. Attached near the outboard end of the outboard screen arm 34 is a screen carrier mount 36 which is part of the screen carrying assembly 30. The screen carrier mount provides an arrangement for removably attaching a screen frame 38.

Figure 3:
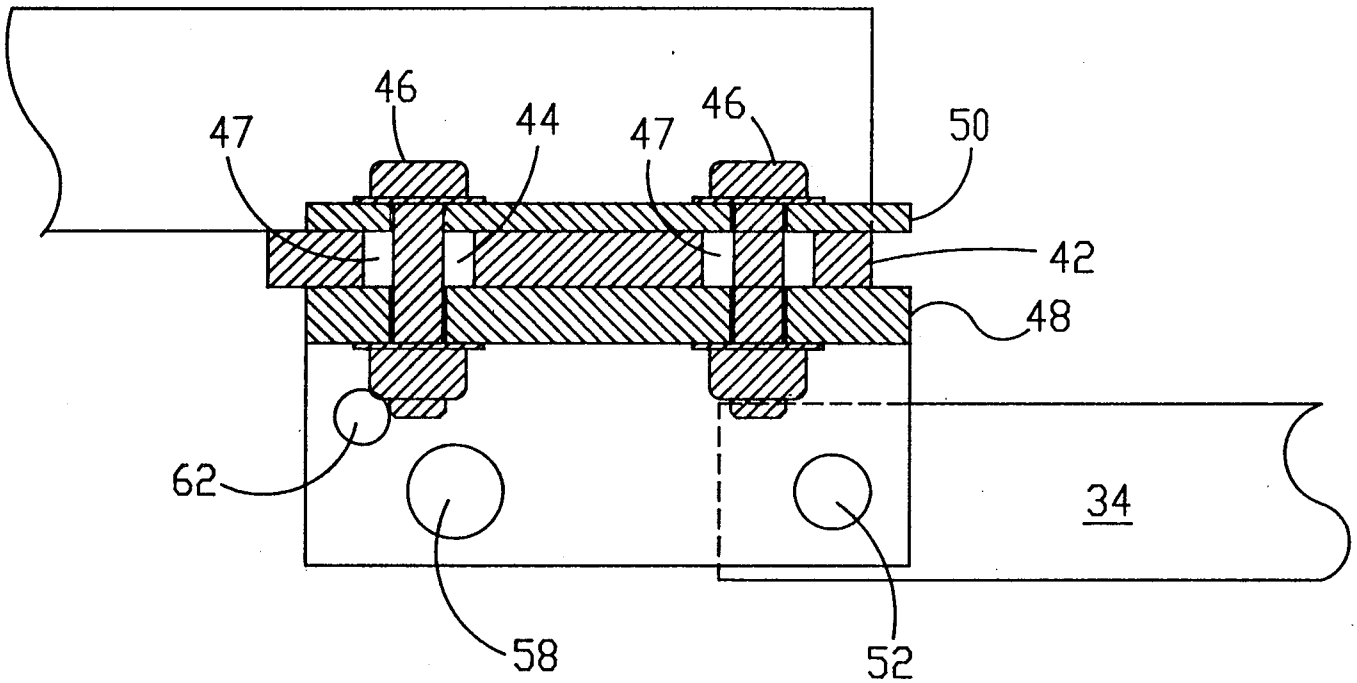
FIG. 3 is a partial sectional view of FIG. 2 showing the moveable connection between the screen arm and the screen arm carrier.
Figure 4:
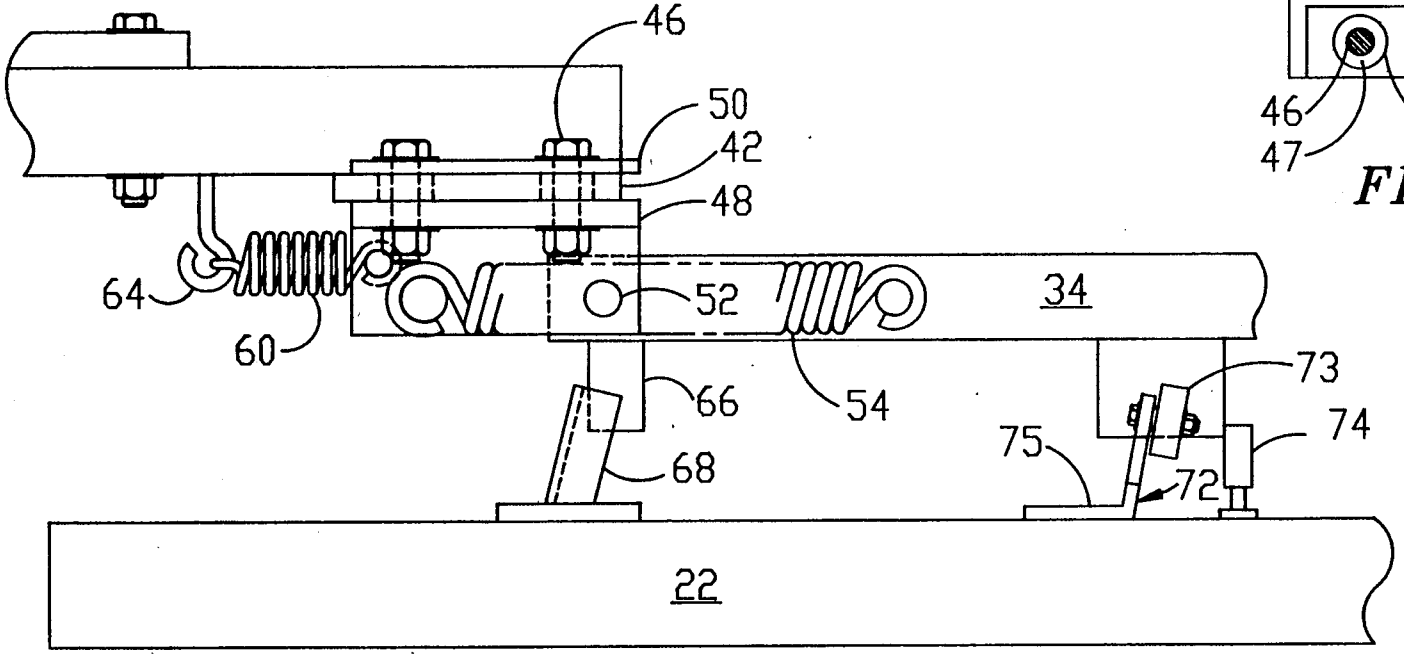
FIG. 4 is a schematic, sectional view showing a screen arm in the lowered or "screen down" position.

The screen frame 38 contains the screen used for printing and must be an accurate registration with the workpiece during the printing operation. Since multiple colors will normally be used each succeeding color that is printed on the workpiece must also be in the same accurate registration. The screen carrier mount 36 for purposes of illustration, is shown as a simple clamping arrangement but preferably the same registration adjustment are shown in FIGS. 2 through 4 of U.S. Pat. No. 4,974,508 would be utilized.

Of critical importance to the invention is a loose or movable connection 40 located somewhere between the screen carrier mount 36 and the part of the screen carrying assembly 30 such as the screen carrier head or mount 31 rigidly carried by the bearing assemblies 28 for rotation around the vertical shaft 14. This loose or movable connection is preferably located between inboard screen arm 32 and outboard screen arm 34. The loose or movable connection is designed to permit a predetermined amount of play between the screen carrying assembly 30 and the screen frame 38 to permit limited movement in a horizontal plane both in a radial direction and in an angular or transverse direction for reasons that will become apparent below. The loose connection 40 as shown in the FIGS. 1 to 7 includes a flat carriage support plate 42 which is positioned in a horizontal plane and preferably welded to the underside of the inboard screen arm 32 near the end thereof. The carriage support plate has four oversized holes 44 therein, two on each side of the inboard screen arm 32. These four oversized holes 44 have loose connectors preferably in the form of carriage bolts 46 which include a shank head and nut fastening a screen arm carriage 48 to the carriage support plate 42 for limited movement in a horizontal place.

Figure 5:
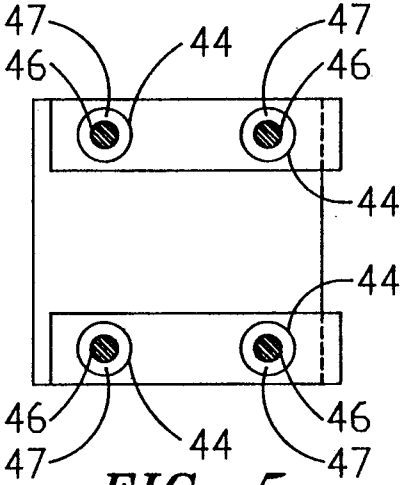
FIG. 5 is a view showing the relationship of the bolt and oversized hole of the moveable connection between the screen arm and the screen arm carrier when the screen arm is in the lowered position.

The fastening arrangement also includes two sliding captive plates 50 one on each side of the inboard screen arm 32. These captive plates 50 are rectangular flat pieces of metal which in effect act as washers for the carriage bolts 46. The bolting arrangement is sufficiently tight to hold the screen arm carriage 48 to the carriage support plate 42 in a horizontal plane but is sufficiently loose to permit free sliding movement of the screen arm carriage relative to the carriage support plate to the extent the diameter of the carriage bolts 46 are permitted to move in the oversized holes 44. This can be any predetermined amount but one preferred size is to have the oversized holes 44 be 9/16 inch inside diameter and the carriage bolts 46 be ¼ inch outside diameter thus permitting a "float" between the bolt 46 and hole 44 in the open annulus 47 as best shown in FIGS. 3, 5 and 7.

Figure 7:
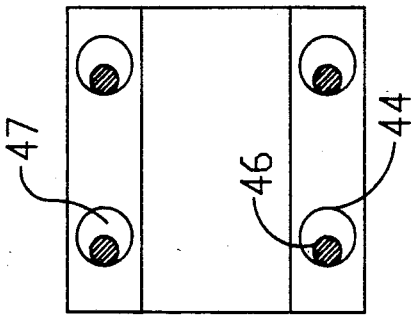
FIG. 7 shows the relationship between the bolt and the oversized hole of the moveable connection between the screen arm and the screen arm carrier when the screen arm is in the raised position.
Figure 6:
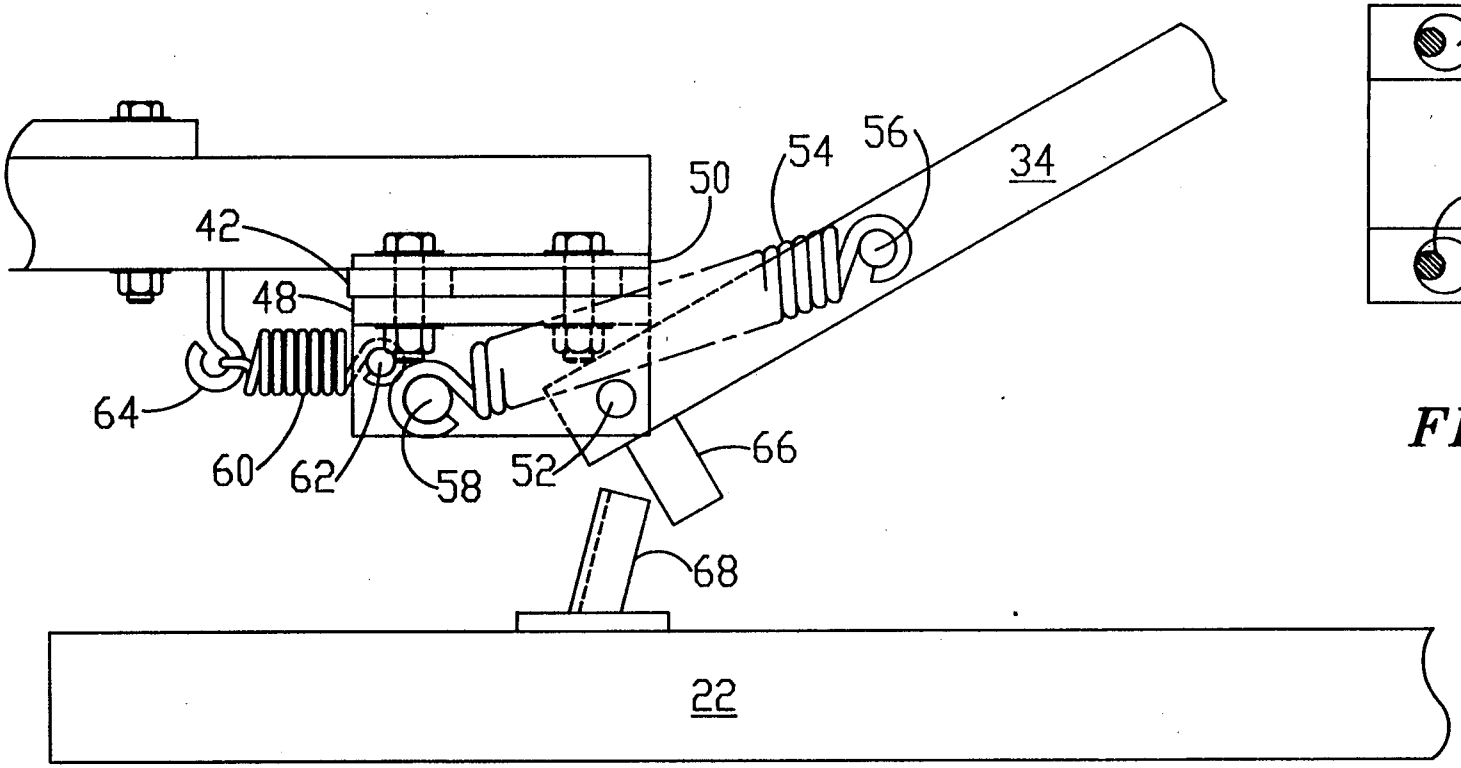
FIG. 6 is a schematic, partial view showing the screen arm in the raised or "screen up" position.

With reference to FIGS. 6 and 7, the workstation is in a "screens up" position with the outboard screen arm 34 raised to the up position pivoting about pivot 52. The outboard screen arm 34 is held in the up position by screen arm spring 54 one of which is on each side of the outboard screen arm 34. One end of each spring 54 is fixed to the outboard screen arm 34 by pin 56 and the other end is fixed to screen arm carriage pin 58 carried by the screen arm carriage 48. The pins 56 and 58 position the springs 54 relative to the pivot 52 in a manner to hold the outboard screen arm 34 in the raised position when it is moved to that position. When it is lowered to the screens down position of FIG. 4 the axis of the springs 54 approach the pivot 52 at the same time elongating the springs and the inboard screen arm 32 will remain in the screens down position even without the screen frame 38 being attached thereto. It is not necessary, although it could be done if such was needed, for the springs 54 to pass through the dead center position by their axis passing below pivot 52. Thus, the screen carrying assembly 30 has a pivoted position which includes the outboard screen arm 34, screen mount 36 and screen frame 38 pivoted about pivot 52. The non-pivoting remainder of the screen carrying assembly 30 includes the screen carrier head 31, inboard screen arm 32 and movable connection 40.

Again with reference to FIGS. 6 and 7 with the screen in the "screens up" position, a carriage tension spring 60 attached at one end to carriage pin 62 mounted on the screen arm carriage 48 and at the other end to descending hook 64 attached to the inboard screen arm 32. The carriage tension spring 60 biases or pulls the screen arm carriage 48 radially inward so that the radial distance of the pivot 52 is at its shortest radial distance from the vertical shaft 14. As shown in FIG. 7, the inward biased movement of the screen arm carriage 48 is arrested from further movement by the carriage bolts 46 hitting the side of the oversized holes 44 that are located nearest to the vertical shaft 14. Thus in the "screens up" position the pivot 52 for the screen frames is biased to its inner most position relative to the vertical shaft 14.

Two complementary distance fixing components are located to join together between the screen carrying assembly and the workpiece carrying assembly. As shown in FIGS. 1, 2, 4 and 6, the first distance fixing component is a rotation member 66 in the form of a short, circular, round bar 66 extending at right angles downward from the outboard screen arm 34 near the pivot 52. The round bar is preferably ⅝ inch diameter cold rolled unfinished steel. The second distance fixing component is a seating member 68 for guiding said rotation member 66 into a rotatable seating position. It is in the form of a V cocked at an angle so that the top of the V which forms a V-angle edge contact is slightly outward and the bottom of the V is fastened to the workpiece support beam 22. The V angle is preferably made from one inch by one inch by ¼ inch thick standard hot rolled steel angle. It is positioned along the support beam so that when the screen is moved to its printing or down position the round bar or rotation member 66 is guided into the V and bottoms out against the converging top sides or V-angle edge contact of the V and at the same time causes the screen arm carriage 48 to move outward against the bias of carriage tension spring 60 to hold the rotation member 66 firmly into position in the V-shaped distance fixing component 68 so that it is held firmly in a fixed radial distance from the vertical shaft 14 and a fixed arcuate or transverse position and radial position relative to the workpiece support beam 22 but is free to rotate about the axis of the rotation member 66.

The apparatus of the present invention is also provided two complementary angle fixing components which fix the angle of rotation of the rotation member 66 to an exact angle so that the screen frame is in exact and repeatable registration with the workpiece when moved to the printing position. As best seen in FIGS. 1, 2 and 4, two complementary angle fixing components comprise a first angle fixing component in the form of a locator member 70 which is a flat plate attached to the underside of the outboard screen arm 34 in a vertical position with the flat plate running in the radial direction relative to the vertical shaft 14. Preferably the flat plate 70 is made of ¼ inch thick cold rolled, unfinished standard steel plate. The second angle fixing component is a straddle member 72 for holding said locator member 70 in a fixed angular position but permits some radial movement relative to the vertical shaft 14. The straddle member 72, is preferably in the form of two rollers 73 on ball bearing supports and are carried by a support bracket 75 mounted on the top of workpiece support beam 22. The support bracket is cocked at a slight angle outward to carry the rollers 73 at a slight angle at the top of their support. The two rollers are mounted apart the thickness of the locator member 70 so that when the locator member 70 is straddled by the two rollers it is held in a precise arcuate position to fix the angle of rotation of the rotation member 66. The two complementary angle fixing components are sometimes referred to as in the industry as a T register. The angle to which the straddle member 72 is cocked outward is chosen to form a substantial tangent to the arcuate downward and upward movement of the locator member as it is rotated to and from the printing position. This is to minimize the amount of rubbing movement of the locator member or plate as it moves into and out of the straddle rollers.

The loose or movable connection 40 is vital to accommodate the movement of the screen outward, sideways and angularly as the rotation member 66 is seated in the distance fixing component 68 and the locator member 70 fixes the angle of rotation by being guided into and held by straddle member 72 so that there is absolute and repeatable registration between the printing screen and workpiece during the printing operation.

With reference to FIGS. 3, 4 and 5 there is shown the arrangement of the loose connection 40 in the screens down position where the bolts 46 have been moved away from their position against the side wall of the oversized holes 44 to a more central position as determined by the complementary distance fixing components and the complementary angle fixing components.

It is to be noted that the distance fixing components and angle fixing components which together are responsible for registration are designed to be located near the outboard end of the workpiece carrying assembly and screen carrying assembly so that even when these assemblies are quite long, such as would be the case in a 10 station machine, the registration is not unduly multiplied as would be the case when the registration arrangement is closer to the vertical shaft 14. As can be seen from FIG. 1, both the distance fixing components and angle fixing components are located preferably closer to the screen carrier mount 36 than to the axis of rotation of the vertical shaft 14. With reference to FIGS. 1 and 4 there is an off contact adjustable stop 74 attached to the outboard screen arm 34 and preferably attached to the outside edge of the locator member 70. The stop 74 may be adjusted by any suitable screw arrangement and serves to stop the downward movement of the printing screen to where it is just above the workpiece.

The off contact provided by adjustable stop 74 is a very desirable feature and usually is adjusted to provide a gap between the screen mesh on the frame and the workpiece platen of between 1/16 inch and 3/16 inch. The feature also requires a rigid structure so that there is no deleterious deflection during the printing operation. The preferred embodiment of the present invention provides the necessary rigidity.

Although the preferred embodiment has been shown with the loose connection located between the screen carrier mount and said screen carrier head or mount, such connection could also be reversed and be located between the workpiece mounts and the workpiece carrier head or mount as long as sufficient play is provided that the complementary distance fixing components which fix the distance from the axis of the vertical shaft can mate with one another so as to fix their distance and arcuate location relative to a vertical axis of rotation and the two complementary angle fixing components can mate with one another to establish the angle of rotation so that the printing screen and workpiece can come into accurate and repeatable registration. Also, in the preferred embodiment the printing screen is pivoted from a "screens up" position to a "screens down" position for the printing operation. This works very well for a manual type of screen printing apparatus. However, if the apparatus is automated, it may be designed that all of the printing screens are in a fixed down position laying in the same horizontal plane and the workpieces are carried in a horizontal plane beneath the screens with all of the workpiece carriers being moved downward and upward relative to the fixed screens. Such an automated arrangement can still utilize the concepts of the inventions set forth herein by having a loose connection biased radially with two complementary angle fixing components and two complementary distance fixing components that marry with one another to achieve accurate and repeatable registration of the printing screen and workpiece.

It is to be noted that with respect to FIG. 4 the rotation member 66 and the locator flat plate member 70 are both rigidly attached to the outboard screen arm 34 and therefore their locations with respect to one another are rigid and in effect the rotation member 66, flat plate member 70 and outboard screen arm 34 function as an integral unit in their movements. Likewise, the distance fixing components or seating member 68 and straddle member 72 are rigidly mounted on platen or workpiece support beam or arm 22 and therefore are rigidly located with respect to one another. In effect the distance fixing component or seating member 68, the straddle member 72 and the workpiece supporting beam or arm 22 function as an integral movement with all of the parts rigidly fixed together.

In setting up the preferred embodiment if, for example, the apparatus has four screens and four workpiece holders, the first step is to take the first screen, or screen number one, and make a print on one of the workpieces and then register the remaining three screens to the print originally made on the first workpiece. Once that is accomplished all of the remaining three stations will also be properly registered even though they were only registered in connection with the first workpiece. While there may be a difference of the fore and aft and sideways movement in the remaining stations with reference to the first station, there will always be the same differences with the first station so that remaining stations will also be always automatically registered to the same relative positions.

Thus, there is provided a screen printing apparatus that can be manufactured without using close manufacturing tolerances but yet will provide precise and repeatable registration between multiple printing screens and multiple workpieces. Standard manufacturing tolerances of plus or minus 1/32 inch on most hole locations can be utilized in the invention with no loss of accuracy of registration.

Prior machines of a type similar to this invention have used the central vertical shaft as the primary reference point with the secondary reference point being the T-register and bearing. The present invention has shifted the primary reference point to the two complementary distance fixing components which preferably include the V angle and round bar. The secondary reference point is the two complementary angle fixing components which preferably are the T-register and bearing. The vertical shaft is not a reference point from the standpoint of registration but merely a convenient means of carrying the assemblies. Both the primary reference point defined by the two complementary distance fixing components and the secondary reference point defined by the angle fixing components are located preferably closer to the screen carrier mount than to the axis of the central vertical shaft even on apparatus with a few stations.

What is claimed is:

1. A multiple screen printing apparatus for multiple simultaneous printing comprising:

a mounting base;

workpiece carrying assemblies having a mount for carrying said workpiece carrying assembly on said base and having a workpiece carrier mount for carrying a workpiece carrier;

screen carrying assemblies having a mount for carrying said screen carrying assemblies on said base and having a screen carrier mount for carrying a printing screen with said screen carrying assemblies and said workpiece carrying assemblies movable with respect to one another;

two complementary distance fixing components with a first distance fixing component being a rotation member and a second distance fixing component being a seating member adapted to guide said rotation member into a rotatable seating position in said seating member;

two complementary angle fixing components with a first angle fixing component being a locator member and the second angle fixing component being a straddle member which holds said locator member in a fixed angular position while permitting radial movement;

one of said distance fixing components and one of said angle fixing components rigidly fixed to said screen carrying assembly at locations which are rigidly fixed with respect to one another and the other of said distance fixing components and said angle fixing components rigidly fixed to said workpiece carrying assembly at locations which are rigidly fixed with respect to one another; and a moveable connection having both in and out and angular play between either said workpiece carrier mount and said workpiece carrying assembly mount or between said screen carrier mount and said screen carrying assembly mount whereby when screens are moved to a screen printing position said seating member guides said rotation member into a seated position that fixed the location of the axis of rotation of said rotation member and said locator member is guided into said straddle member to fix the angle of rotation and register the printing screens and workpieces with one another.

2. A multiple screen printing apparatus for multiple simultaneous printing comprising:

a mounting base;

workpiece carrying assemblies carried on said base and having a workpiece carrier mount for carrying a workpiece carrier;

screen carrying assemblies having a non-pivoted portion carried on said base and having a screen carrier mount for carrying a printing screen with said screen carrying assemblies and said workpiece carrying assemblies rotatable with respect to one another;

a plurality of outboard screen arms having an inner end and an outer end included with said screen carrying assemblies and to which said screen carrier mounts are attached;

two complementary distance fixing components with a first distance fixing component being a rotation member and a second distance fixing component being a seating member for guiding said rotation member into a rotatable seating position in said seating member;

two complementary angle fixing components with a first angle fixing component being a locator member and the second angle fixing component being a straddle member for holding said locator member in a fixed angular position but permitting radial movement;

one of said distance fixing components and one of said angle fixing components rigidly fixed to one of said outboard screen arms at locations which are rigidly fixed with respect to one another and the other of said distance fixing components and said angle fixing components are rigidly fixed with respect to one another and the other of said distance fixing components and said angle fixing components rigidly fixed to said workpiece carrying assembly which are rigidly fixed with respect to one another; and a moveable connection having both radial and angular play located between said outboard screen arm and the non-pivoted remainder portion of said screen carrying assembly, said outboard screen arms being pivotably connected to said movable connection for up and down movement whereby when screens are pivoted to a screen printing down position said seating member guides said rotation member into a seated position that fixes the location of the axis of rotation of said rotation member and said locator member is guided into said straddle member to fix the angle of rotation and register the printing screens and workpieces with one another.

3. The apparatus of claim 2 wherein:

a bias mechanism is attached to said moveable connection and said outboard screen arm for assisting in the raising and holding of said outboard spring arm in an up position when it is raised to such position and permit said outboard screen arm to remain in the printing and down position when it is moved to that position.

4. The apparatus of claim 3 wherein said moveable connection is a sliding carriage comprising:

a carriage member having a flat surface rigidly attached to the inner end of said outboard screen arm;

a carriage support member having a flat surface rigidly attached to said non-pivoted portion of said screen carrying assembly; and a loose connector between said carriage support member and said carriage member that permits said flat surface of said carriage members and said flat surface of said carriage support member to slide to a limited amount with respect to one another.

5. The apparatus of claim 4 wherein:

said carriage support member has at least one oversize hole therein; and said loose connector is a shank attached to said carriage member and extending into said oversize hole with an outside dimension smaller than said oversize hole and said limited amount of sliding determined by the difference in size of said shank and said hole.

6. The apparatus of claim 5 wherein:

said rotation member is a round bar; and said seating member is a V formed by an angle for guiding said round bar into a rotatable seating position.

7. The apparatus of claim 6 wherein:

said locator member is a vertical flat plate extending generally in a radial direction; and said straddle member comprises two rollers spaced apart substantially the thickness of said vertical flat plate.

8. The apparatus of claim 7 wherein:

said V-angle is inclined to the vertical so said round bar contacts the V-angle at the edge thereof.

9. The apparatus of claim 8 wherein:

said straddle member is inclined to the vertical to be approximately tangent to the pivot arc of said vertical flat plate.

10. The apparatus of claim 5 wherein:

a vertical shaft is mounted on said mounting base;

with said screen carrying assembly mount rotating around said vertical shaft;

an inboard screen arm having an outer end underside rigidly attached to said screen carrying assembly mount;

said carriage support member being a flat plate rigidly attached to said outer end underside of said inboard screen arm with a side extension having two of said oversize holes located on each side of said inboard screen arm;

a sliding captive plate having two holes therein placed over said oversize holes located on each of said side extensions; and said shanks in the form of a bolt with head and nut extending through each of said captive plate holes and oversize holes to movably attach said screen arm carriage to said carriage support plate.

11. The apparatus of claim 10 which further includes:

at least one carriage tension spring having a first end attached to said screen arm carriage and a second end attached to said inboard screen arm for biasing said screen arm carriage radially inward.

12. The apparatus of claim 2 which further includes:

a biasing mechanism connected to said moveable connection for biasing at least part of said moveable connection radially inward.

13. The apparatus of claim 12 wherein said biasing mechanism is at least one tension spring.

14. The apparatus of claim 2 wherein said workpiece carrying assemblies are rotatably mounted on said mounting base.

15. The apparatus of claim 2 wherein said screen carrying assemblies are rotatably mounted on said mounting base.

16. The apparatus of claim 15 wherein said workpiece carrying assemblies are rotatably mounted on said mounting base for coaxial rotation with respect to said screen carrying assemblies.

17. The apparatus of claim 11 wherein said workpiece carrying assemblies are mounted on said mounting base for coaxial rotation with respect to said screen carrying assemblies.

18. The apparatus of claim 17 which includes a stop affixed to said screen carrying assemblies near said workpiece carrier mounts for spacing the screen a predetermined distance from the workpiece during printing.

19. The apparatus of claim 18 wherein:

said locator member has an outboard edge; and said stop is attached to the outboard edge of said locator member.

20. A screen printing apparatus for accurate and repeatable registration of a printing screen with a workpiece comprising:

a screen carrying assembly having a mount and a screen carrier mount;

a workpiece carrying assembly having a support mount and a workpiece carrier mount cantilevered in a generally horizontal direction with said workpiece carrying assembly and said screen carrying assembly rotating with respect to one another and adapted to close to a printing position and open to a rotation position with respect to one another; and a registration arrangement which include:

two complementary distance fixing components with a first distance fixing component being a rotation member and a second distance fixing component being a seating member for guiding said rotation member into a rotatable seating position in said seating member;

two complementary angle fixing components with a first angle fixing component being a locator member and the second angle fixing component being a straddle member for holding said locator member in a fixed angular position but permitting radial movement;

one of said distance fixing components and one of said angle fixing components rigidly fixed to said screen carrying assembly at locations which are rigidly fixed with respect to one another and the other of said distance fixing components and said angle fixing components rigidly fixed to said workpiece carrying assembly a location which are rigidly fixed with respect to one another; and a moveable connection having both radial and angular play located on either said workpiece carrying assembly between said workpiece carrying assembly mount and said workpiece carrier mount or said screen carrying assembly between said screen carrying assembly mount and said screen carrier mount whereby when screens are moved to a screen printing position said seating member guides said rotation member into a seated position that fixes the location of the axis of rotation of said rotation member and said locator member is guided into said straddle member to fix the angle of rotation and register the printing screens and workpieces with one another.

* * * * *